US006933472B1

(12) United States Patent
Smith et al.

(10) Patent No.: US 6,933,472 B1
(45) Date of Patent: Aug. 23, 2005

(54) ELECTRIC CONVECTION OVEN

(75) Inventors: Robert L. Smith, Westford, VT (US); David Shangraw, Burlington, VT (US)

(73) Assignee: Blodgett Holdings, Inc., Burlington, VT (US)

( * ) Notice: Subject to any disclaimer, the term of this patent is extended or adjusted under 35 U.S.C. 154(b) by 0 days.

(21) Appl. No.: 10/712,013

(22) Filed: Nov. 14, 2003

(51) Int. Cl.[7] ..... A21B 1/26; F24C 15/32
(52) U.S. Cl. ..... 219/400; 126/21 A; 99/476
(58) Field of Search ..... 219/400; 126/21 A; 99/476

(56) References Cited

U.S. PATENT DOCUMENTS 4,395,233 A * 7/1983 Smith et al. ..... 126/21 A
4,516,012 A * 5/1985 Smith et al. ..... 219/400
4,928,663 A * 5/1990 Nevin et al. ..... 126/21 A
5,497,760 A * 3/1996 Alden et al. ..... 126/21 A
6,188,045 B1 * 2/2001 Hansen et al. ..... 219/400

* cited by examiner

*Primary Examiner*—Joseph Pelham
(74) *Attorney, Agent, or Firm*—Brinks Hofer Gilson & Lione

(57) ABSTRACT

An electric convection oven is provided wherein a squirrel cage fan is used to circulate air through a circular bank of heating coils surrounding the fan and into the oven. The coils wrap around the fan and are spaced from each other so that air from the fan will pass through the coils and into the oven. The fan is provided with a concave centrally located plate for drawing air from within the oven into the fan for recirculation through the heating coils and to return to the oven.

8 Claims, 3 Drawing Sheets

ELECTRIC CONVECTION OVEN

BACKGROUND OF THE INVENTION

This invention is related to a commercial electric oven and in particular to an electric convection oven which re-circulates heated air efficiently for uniform cooking.

DESCRIPTION OF THE PRIOR ART

Convection ovens operate by circulating heated air within an oven and the efficiency of this circulation dictates the quality of the cooking. It is necessary then to avoid hot spots and to uniformly disperse heated air within the oven cavity.

In commercial kitchens, space is often at a premium. The overall outside dimensions of an oven are very important, then, as it is necessary to fit the kitchen equipment into the available space. Obviously, it would be desirable to maximize the cooking capacity of each oven within the given outside dimensions.

In gas fired convection ovens it is necessary to house burners within the oven and this requirement diminishes the available cooking space within the oven cavity. In certain of such gas fired convection ovens such as that described in U.S. Pat. No. 4,928,663 the outer shell has an inner liner spaced away from the shell so that heated products of combustion can circulate around the liner to heat the walls thereof. The oven cooking cavity then is the space within the liner.

In U.S. Pat. No. 5,497,760 assigned to the assignee of this invention an attempt was made to design a gas fired convection oven wherein the liner was immediately adjacent the outside wall of the oven to eliminate most of the unused space in prior designs. In order to facilitate such a design, in-shot burners were vertically mounted in one side wall and the products of combustions expelled into a fan, axially. A plenum chamber was provided adjacent the fan wherein heated air from within the oven was mixed with the products of combustion and then expelled into the oven cavity. This design eliminates some of the lost cooking space, but still must provide for the in-shot burners and plenum space in one of the walls of the oven cavity. The disclosure of that patent is hereby incorporated by reference.

In such convection ovens the preferred fan is a squirrel cage type fan, and in the above-referenced patents, the squirrel cage fan used is provided with a concave plate covering one face which plate has holes in it. As the fan rotates then an area of low pressure develops in the concavity, and products of combustion are drawn into the fan to be mixed with air from within the oven and expelled radially. A different type of fan for achieving this objective is shown in U.S. Pat. Nos. 4,395,233 and 4,516,012 also assigned to the assignee of this invention.

In gas fired convection ovens the fan design such as that in U.S. Pat. No. 5,497,760 was essential to drawing products of combustion in to the oven cavity and subsequently mixing such products of combustion with air within the cavity for subsequent return to the cooking portion of the oven cavity. Products of combustion from the burners in various oven designs were circulated around baffles or through constricted areas before entry into the fan. The concavity then in the fan was necessary in order to create an area of low pressure to draw such products of combustion into the fan proper. Typically the fan is mounted behind the baffle plate having a central opening and against a wall of the oven. The oven wall would have one or more ports therethrough for admission of the products of combustion into the fan, and the central opening on the baffle plate would be used to admit air from within the oven proper. The mixed air and combustion products then are expelled radially by the fan around the baffle plate and into the oven chamber. The fan then is used to provide a dual flow circulated into the oven for cooking.

Accordingly, there remains a need for providing a convection oven design wherein circulation is efficiently maximized and the oven cavity itself exhibits maximum dimensions.

SUMMARY OF THE INVENTION

It has been discovered that an electric convection oven can be provided wherein circulation is efficient and also wherein a separate lining, and space for the heat source is not necessary.

According to the design of this invention, a fan of a squirrel cage type design, preferably having a concave plate centrally located is disposed adjacent one wall and a vertical baffle plate is used to separate the fan from the cooking cavity. The baffle plate has a central opening coaxial with the axis of rotation of the fan for admitting heated air from within the cavity into the fan for radial expulsion.

The heat source for the oven of this invention is a bank of circular heating elements which surround the fan, and are disposed within the baffle plate. Air from within the oven cavity then is drawn into the fan, and expelled through the heating elements, radially, to be heated by said elements, and returned around the baffle plate into the oven cavity for recirculation. Heated air, as it expands, is expelled through a conventional flue. The baffle plate typically mounts a mesh over the central opening and is spaced away from the oven wall on all four sides to permit the passage of heated air.

The inside wall of the oven cavity and the baffle plate may be porcelainized, or constructed of stainless steel.

Since the oven is heated electrically rather than with products of combustion, it is not necessary to establish a dual flow wherein the products of combustion are drawn into the oven by the fan. The fan used to establish a dual flow in gas-fired ovens has been found to be efficient to circulate heated air from within the oven through the heating elements where it is heated again, and then returned to the oven cavity itself.

Accordingly it is an object of this invention to provide an electric convection oven wherein air from within the oven is circulated through heating elements and then returned to the oven.

It is another object of this invention to provide an electric convection oven wherein the source of heat is a plurality of banks of circular heating elements which surround the fan and are spaced apart one from the other to permit a flow of air from the fan through the heating elements to heat the same for return to the oven cavity.

It is a still another object of this invention to provide an electric convection oven wherein the cooking space is maximized within the outside dimensions of the oven by using an electric source of heat rather than gas fired burners and in which the air to be heated is circulated by a squirrel cage fan having an inner concavity.

These and other objects will become readily apparent with reference to the drawings and following description wherein:

DETAILED DESCRIPTION OF THE INVENTION

Figure 1:
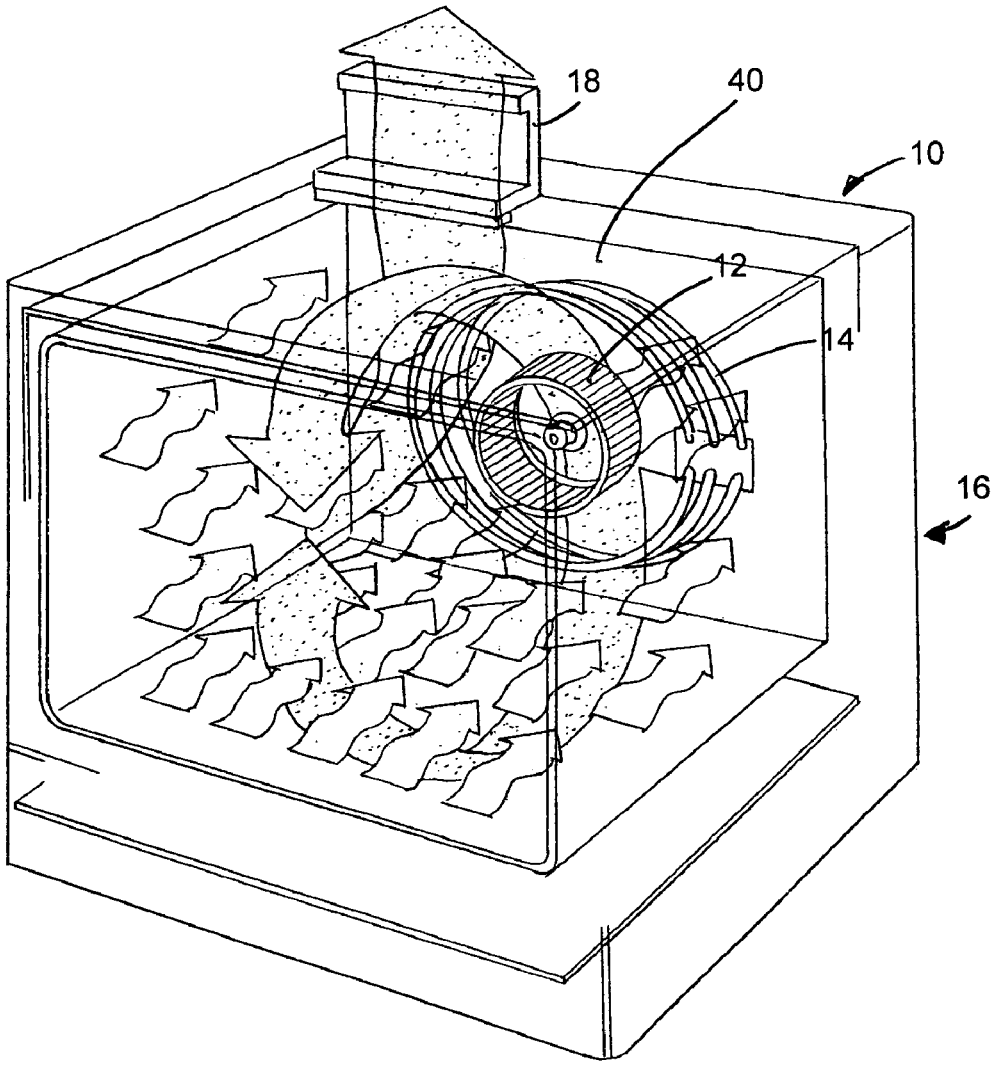
FIG. 1 is a schematic representation of the circulation of heating air within the oven of this invention wherein the baffle plate has been removed.
Figure 2:
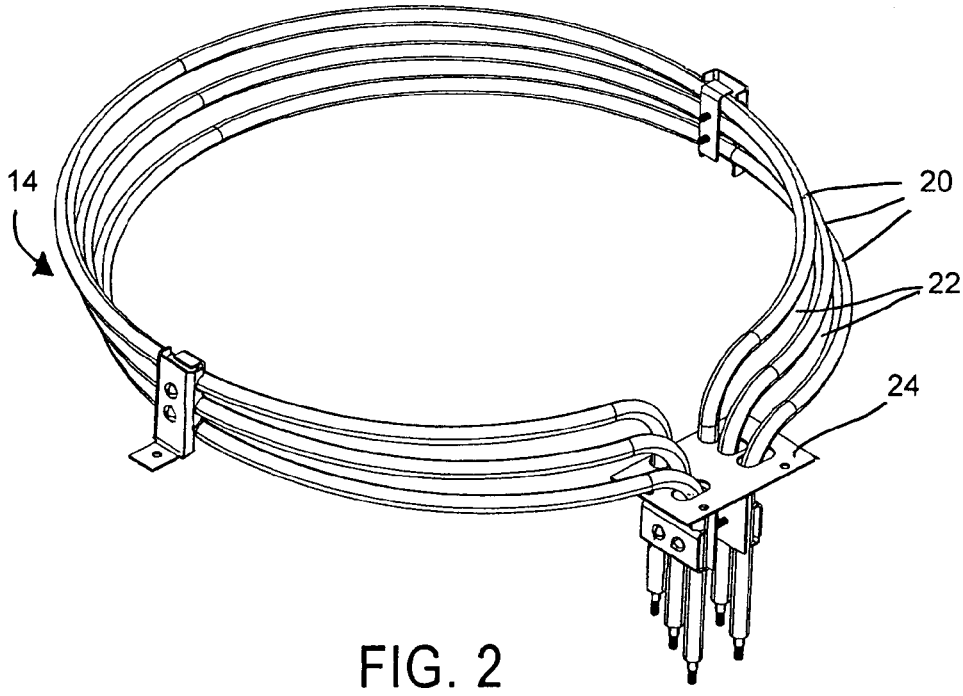
FIG. 2 is a perspective view of the heat source for the oven of FIG. 1.

The oven of this invention 10 uses a squirrel cage fan 12 to circulate air from within the oven cavity through a bank of heating coils 14 wherein the air is heated and returned to the oven cavity 16. Air from within the cavity 16 is vented through a conventional flue 18.

The heating means 14 is preferably a plurality of resistance elements 20 which are circular, and surround the fan 12. Spaces 22 are disposed between elements 20 to permit the passage of air from the fan therethrough. Heating elements 14 would be mounted by plate 24 and coupled to a source of electrical energy (not shown).

Figure 3:
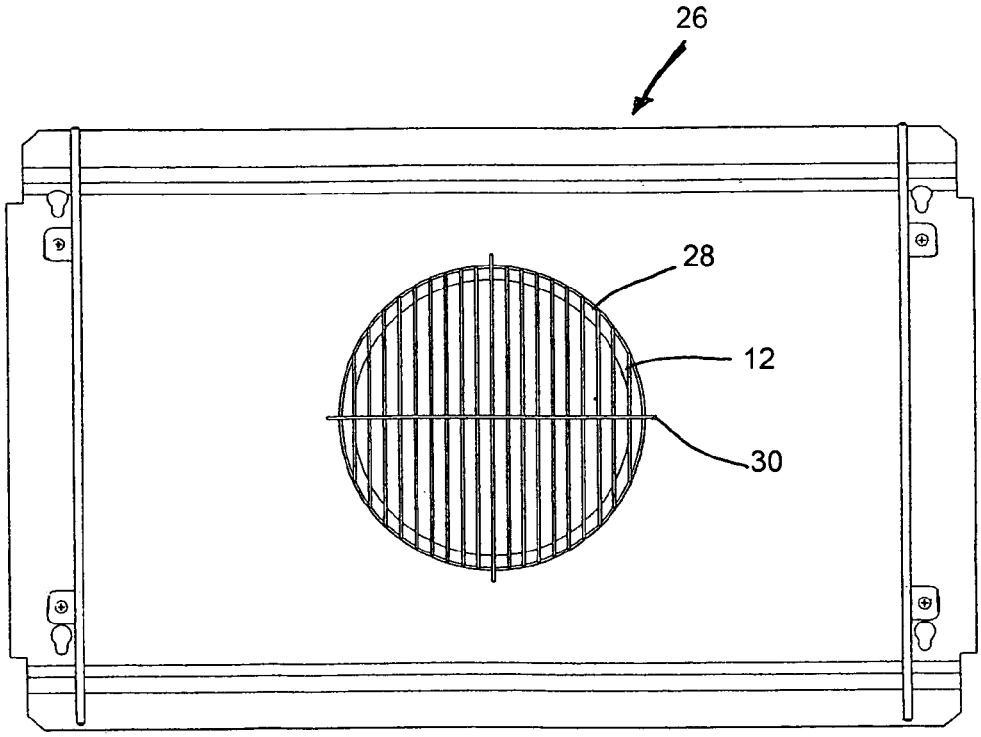
FIG. 3 is a front view of the baffle plate for the oven of this invention.
Figure 4:
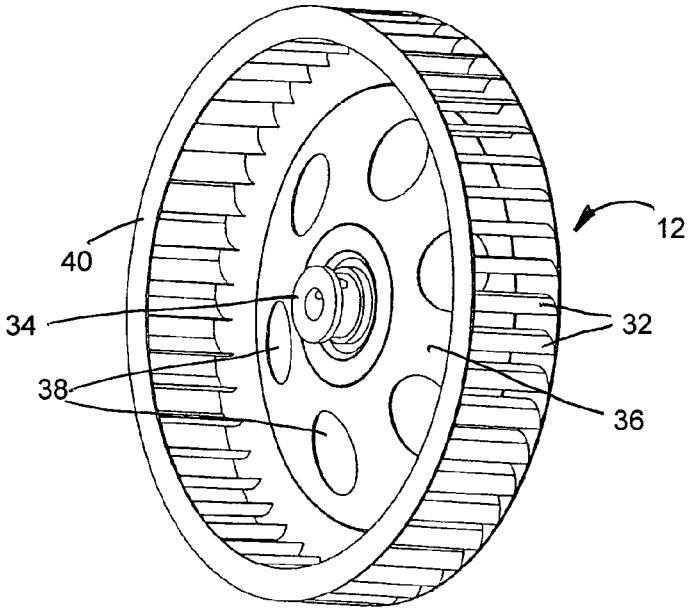
FIG. 4 is a perspective view of the fan used in the oven of FIG. 1.
Figure 5:
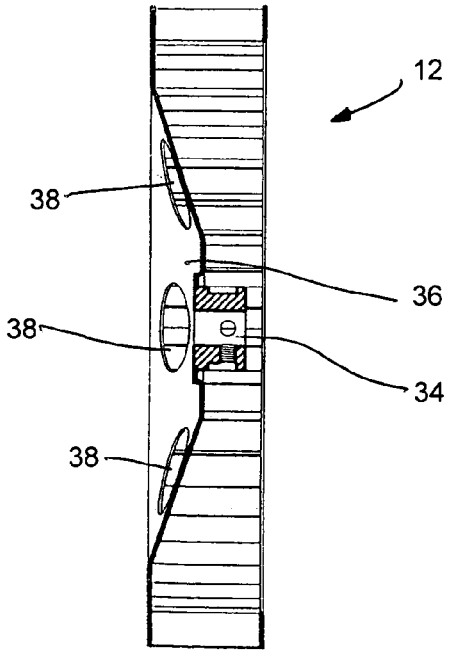
FIG. 5 is a side view of the fan of FIG. 4.

With attention to FIG. 3, a baffle plate 26 having a central opening 28 is disposed between the fan 12 and the cooking cavity 16. The fan 12 is shown schematically in FIG. 3. The central opening 28 preferably would have a mesh protector 30 to minimize food particles entering the fan itself.

Baffle plate 26 is dimensioned to permit the passage of heated air from the fan around the peripheral portion and into the oven cavity. This baffle plate then functions as the baffle plate did in U.S. Pat. No. 5,497,760 described above.

The fan 12 has a plurality of blades 32 surrounding a central axis coupling 34 which is coupled to a dry shaft (not shown). Surrounding the coupling 34 is a concave plate 36 with a plurality of holes 38 therethrough.

The open face 40 of fan 12 is disposed adjacent to baffle plate 26 and the concave plate 36 opens into the back wall 40 of the oven cavity 16. As the fan 12 rotates, air from within the oven cavity is drawn thereinto through opening 28 in baffle plate 26 and expelled radially through blades 32 of fan 12. The heated air then passes through the coils 14 and returns to the oven as shown in FIG. 1.

While the concave plate 36 does not function to draw combustion products into the oven, it does facilitate circulation of air from within the oven through the heating coils. Because the coils 14 are banked, and separated one from the other, air then passes through the coils to be heated. In addition, by providing circular coils 14 to surround the fan 12, a uniform flow of heated air will be returned to the oven around baffle plate 26.

By eliminating gas-fired burners, space within the oven 10 for cooking will be maximized. It is therefore unnecessary to, for example, provide a liner for the oven cavity to circulate hot products of combustion around the outside thereof or to provide space within the oven cavity for mounting the burners.

It will be readily seen by one of ordinary skill in the art that the present invention fulfills all of the objects set forth above. After reading the foregoing specification, one of ordinary skill will be able to effect carious changes, substitutions or equivalents and various other aspects of the invention as broadly disclosed herein. It is therefore intended that the protection granted hereon be limited only by the definition contained in the appended claims and equivalents thereof.

What is claimed is:

1. A convection oven, comprising:

an insulated housing having rear and side walls and a front wall having an access door, said housing defining a cooking cavity;

a squirrel-cage fan mounted within said cavity adjacent one of said walls of said housing, said fan having an internal concave plate on a side thereof adjacent said wall, said plate being disposed coaxially with an axis of rotation of said fan and having a plurality of holes therethrough, a baffle plate mounted within said cavity parallel to, and spaced away from, the wall mounting said fan, said baffle plate having a central opening registering on said fan, said fan being disposed between said plate and said housing wall; and an electrical coil heater surrounding said fan and disposed between said plate and said wall for heating air radially expelled by said fan.

2. The oven of claim 1 wherein said mounting wall is in the back wall of said housing.

3. The oven of claim 1 further comprising mesh covering the opening in said baffle plate.

4. The oven of claim 1 wherein the opening in said baffle plate is circular and has a diameter substantially the same as that of said concave plate.

5. The oven of claim 1 wherein said heater is circular.

6. The oven of claim 5 wherein said heater comprises a plurality of circular resistance elements.

7. The oven of claim 6 wherein three of said elements are provided, each having a different diameter.

8. The oven of claim 6 wherein each element is spaced a different distance from said housing whereby air expelled by said fan will pass through said elements.

* * * * *